United States Patent [19]

Hammer et al.

[11] 3,931,080

[45] Jan. 6, 1976

[54] AQUEOUS AMINOPLAST COATING COMPOSITION WITH POLYMERS OF FLUORINATED ETHYLENE IMINES

[75] Inventors: Klaus-Dieter Hammer, Mainz; Wolfgang Heinrich, Wiesbaden; Dieter Hoffmann, Bobingen; Erich Schuierer, Altotting, all of Germany

[73] Assignee: Hoechst Aktiengesellschaft, Frankfurt, Germany

[22] Filed: Dec. 3, 1973

[21] Appl. No.: 421,095

[30] Foreign Application Priority Data

Dec. 6, 1972 Germany ..... 2259613

[52] U.S. Cl. .... 260/29.4 R; 260/29.2 TN; 260/849; 260/859; 260/DIG. 19; 428/91; 428/421; 428/425; 428/904

[51] Int. Cl.[2] ..... B23B 27/40; B23B 27/42; C08L 61/34; C08L 75/12

[58] Field of Search ..... 117/135.5; 260/29.4 R

[56] References Cited

UNITED STATES PATENTS

| | | | |
|---|---|---|---|
| 3,491,169 | 1/1970 | Raynolds et al. | 260/29.4 R |
| 3,652,513 | 3/1972 | Gagliardi | 260/80.3 |
| 3,655,732 | 4/1972 | Scriver | 117/135.5 |
| 3,679,634 | 7/1972 | Schuierer et al. | 117/135.5 |
| 3,721,700 | 3/1973 | Schuierer et al. | 117/121 |

*Primary Examiner*—Murray Tillman
*Assistant Examiner*—Arthur H. Koeckert
*Attorney, Agent, or Firm*—Connolly and Hutz

[57] ABSTRACT

An aqueous composition containing (A) an aminoplast precondensate, (B) a polymeric ethylene imine, the monomer of which is a reaction product of toluenediisocyanate a fluorinated alkanol and ethylene imine, which polymer is dispersed by means of a dispersant obtained by reacting said fluorinated alkanol, toluenediisocyanate and a polyethylene glycol, (C) a long-chain alkyl urea and (D) a cross-linking catalyst is useful for rendering a velvety suede-like polyurethane structure oil- and water-repellant.

15 Claims, No Drawings

AQUEOUS AMINOPLAST COATING COMPOSITION WITH POLYMERS OF FLUORINATED ETHYLENE IMINES

The present invention relates to compositions and a process for the oleophobic and hydrophobic finishing of flat and shaped structures of polyurethane having a velvety rough surface, especially multi-layer flat structures having at least one surface of polyurethane.

It is generally known that plastics surfaces have the tendency to acquire an electrostatic charge and thus attract dust and dirt from the environment. With roughened surfaces this is especially disadvantageous as the soiling deposits are difficult to remove by brushing or wiping. This undesired property is particularly disturbing with shoe and clothing material of synthetics having suede-like properties. Inspite of repeated cleaning such goods become rapidly mean-looking and lose their brilliancy of color.

This drawback can be remedied to a certain extent by providing the surface of such articles with an antistatic finish. But such a finish will not last since the applied antistatic agents are hydrophilic and water-soluble so that they do not withstand the attack of water and are soon washed off the surface. Moreover, substances of this type increase the wetting properties of the surface and thus in the case of relatively porous roughened sufaces the penetration of water from the outside is favored. This is an effect which is not at all desired with shoe and clothing material.

It has, therefore, been proposed to prevent the peneration of water into synthetic leather substitutes with velvety or suede-like surface by inserting a dense, compact and water impermeable polyurethane layer between the rough surface of said material and its textile supporting layer. Such a water impermeable interlayer prevents the water from penetrating from the outside, but simultaneously it forms an undesired blocking layer for water vapor and air hindering any exchange with the ambient atmosphere, which detrimentally affects the wearing comfort of shoes and garments made from materials of this type.

It is, therefore, the object of the present invention to render such a rough and suede-like surface of plastics material oil- and water-repellant in such a manner that it keeps these properties also after washing or dry-cleaning and simultaneously remains sufficiently permeable to water vapor and air.

The present invention provides an aqueous finishing composition to render oil- and water-repellant flat or shaped structures having a suede-like surface of a polyurethane layer, which composition comprises A. 1 to 10 % by weight of an aminoplast precondensate capable of being cross-linked, B. 0.1 to 3 % by weight of a fluorine-containing two-component system composed of $\beta_1$. a polymer of at least one fluorine-containing ethylene-imine of the formula

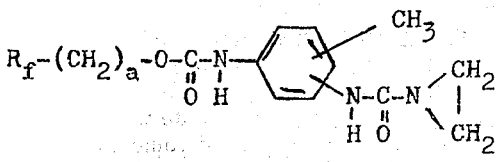

in which $R_f$ represents a straight or branched, saturated perfluorocarbon chain of 6 to 10 carbon atoms and $a$ is 1 or 2, dispersed in $\beta_2$. at least one fluorine-containing compound of the formula

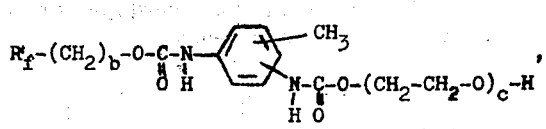

in which $R'_f$ represents a straight or branched, saturated perfluorocarbon chain of 5 to 7 carbon atoms, $b$ is 1 or 2 and $c$ is 18 to 50 (corresponding to polyethylene glycol radicals of a mean molecular weight of about 800 to about 2,000)

the ratio of components $\beta_1$ to $\beta_2$ in component B being in the range of from 40 to 60 to 60 to 40 % by weight, C. 0.05 to 2 % by weight of a urea derivative of the formula

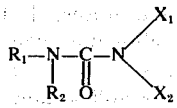

in which $R_1$ is a straight chain or branched alkyl radical of 8 to 24 carbon atoms, $R_2$, $X_1$ and $X_2$ each is hydrogen

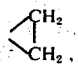

the percentages by weight of (A), (B) and (C) being calculated on the total weight of the aqueous composition, and D. 5 to 80 % by weight, calculated on the weight of (A) of a water-soluble inorganic cross-linking catalyst.

The aqueous finishing composition of the invention is applied to the surface to be rendered oil- and water-repellent in an amount of from 60 to 150 g/m², preferably 80 to 100 g/m². Any known mode of application is suitable, for example padding (foularding) and preferably spraying. After application of the aqueous composition the flat or shaped structure is dried at a temperature of from 80° to 140°C, preferably 100° to 120°C, for example by ultrasonics or under reduced pressure, with infra-red radiation, or preferably in a drying closet operated with hot air. It is subsequently cured by a heat treatment at a temperature of from 100° to 180°C, preferably 140° to 160°C for 30 seconds to 15 minutes, preferably 1 to 5 minutes. Under the action of elevated temperatures, beginning during the drying period, the reactive components of the finishing composition undergo chemical reaction with curing of the forming coating on the surface of the structure to be finished.

Component (A) of the aqueous finishing composition of the invention consists of a precondensate of the group of known aminoplasts, i.e. a condensation product of a condensable amine component with an aldehyde, which precondensate is contained in the composition in an amount of from 1 to 10, preferably 1 to 7.5

% by weight, calculated on the total weight of the aqueous composition. Especially suitable are precondensates consisting, on the one hand, of formaldehyde and, on the other, of melamine or the derivatives thereof, or urea and its derivatives (cf. Angew. Chemie 76 (1964), 909–919).

Besides melamine and urea the following compounds are preferred as amine components

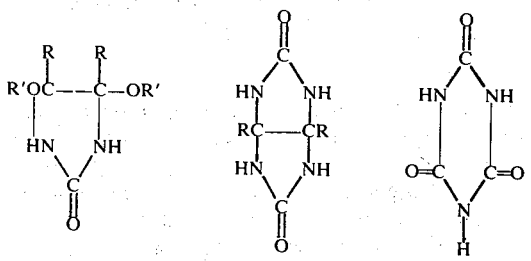

in which R and R′ each is a short chain alkyl radical of 1 to 4 carbon atoms, above all methyl and preferably hydrogen.

Besides the said usual aminoplast precondensates, all reaction products of the aforesaid amine components with low molecular aliphatic aldehydes, preferably formaldehyde, having a degree of condensation such that the condensates are still soluble in usual solvents, preferably water, are also encompassed by the term "precondensate".

In the porous coating forming on the surface the aminoplast component has the function of a binder and support in which the other components or the reaction products thereof are randomly distributed.

Component (B) consists of $\beta_1$. polymers of at least one fluorine-containing ethylene-imine of the formula

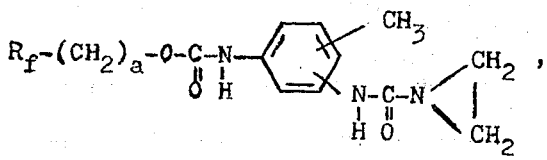

in which $R_f$ is a straight or branched, saturated perfluorocarbon chain of 6 to 10 carbon atoms and $a$ is 1 or 2 and $\beta_2$. at least one fluorine-containing compound of the formula

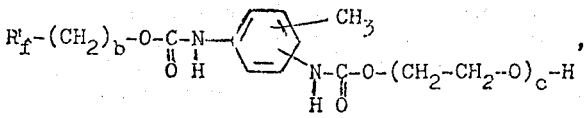

in which $R'_f$ is a straight or branched, saturated perfluorocarbon chain of 5 to 7 carbon atoms, $b$ is 1 or 2 and $c$ is 18 to 50, corresponding to polyethylene glycol radicals having a mean molecular weight of about 800 to about 2,000. The fluorine-containing compounds ($\beta_1$) and ($\beta_2$) render the coating oil- and water-repellent, compound $\beta_2$ having the additional function to transform the water-insoluble $\beta_1$ polymers into stable aqueous dispersions.

These two classes of compounds, their manufacture and application in textile finishing are described in U.S. Pat. NO. 3,721,700. Polymers of compounds $\beta_1$ are further described in U.S. Pat. No. 3,679,634.

The ratio of $\beta_1$ to $\beta_2$ in component (B) is in the range of from 40 : 60 to 60 : 40 % by weight, a ratio of 50 : 50 being preferred. In its manufacture component (B) is obtained in the form of an aqueous dispersion containing $\beta_1 + \beta_2$ in an amount of from 10 to 30, preferably 25 % by weight, calculated on the total weight of the dispersion. Compound B is preferably added to the aqueous finishing composition of the invention in the form of such an aqueous dispersion, the amount being calculated on the intended quantity.

In the polymerization of fluorine-containing ethylene-imines of group $\beta_1$ those are preferably used in which the radical $R_f$ has a chain length of 7 to 8 carbon atoms in straight or branched arrangement or mixtures thereof, or mixtures with radicals $R_f$ having a chain length of 6 to 10 carbon atoms containing a preponderant proportion of $C_7$ and/or $C_8$ groups. Especially preferred fluorine-containing polyethylene glycol derivatives of formula $\beta_2$ are those in which the number of polyethylene glycol radicals $c$ is in the range of from 23 to 46, corresponding to a mean molecular weight of 1,000 to 2,000. Polyethylene glycol radicals having a mean molecular weight of 1,000 have proved particularly advantageous.

Owing to their extremely intensive effect the perfluorinated compounds of component (B) can be used in a relatively small amount, their proportion in the total aqueous finishing composition being 0.1 to 3, preferably 0.2 to 0.7 % by weight.

The composition of the invention further contains a component (C) which shall confer upon the velvety, suede-like surface a pleasant handle. It is composed of urea derivatives of the formula

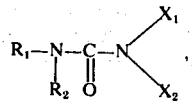

in which $R_1$ is a branched, preferably, however, straight chain, generally unsubstituted alkyl radical of 8 to 24, preferably 12 to 22 carbon atoms, $R_2$ $X_1$ and $X_2$ each is hydrogen or $CH_2OH$, or $X_1$ and $X_2$ together are

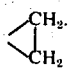

This class of compounds has a fat-like consistency and is easy to incorporate into the total system. Preferred compounds of this class are stearyltrimethylolurea and octadecyl-ethylene-urea. Such urea derivatives are described in U.S. Pat. Nos. 2,222,208 and 2,312,863. Component (C) is introduced into the finishing composition of the invention in an amount of from 0.05 to 2 % by weight, preferably 0.1 to 1.5 % by weight, calculated on the total weight thereof.

For cross-linking the composition of the invention contains a suitable catalyst, the amount of which is dependent on the weight of the aminoplast precondensate, being in the range of from 5 to 80 % by weight, preferably 10 to 60 % by weight of component (A). Suitable cross-linking catalysts are inorganic water-soluble salts of the known group of acid condensation catalysts, especially ammonium chloride, magnesium chloride, zinc chloride, zinc nitrate, $Zn(BF_4)_2$ or $AlCl_3$.

The aqueous finishing composition of the invention is prepared by intensely mixing an aqueous solution containing 30 to 70 and preferably 50 % by weight of component (A), an aqueous dispersion containing 10 to 30 and preferably 25 % by weight of component (B), an aqueous dispersion containing 10 to 30 and preferably 20 % by weight of component (C) with an aqueous solution of 40 to 60 and preferably 50 % by weight of component (D), depensing on the intended composition the proportions being chosen within the indicated limits for the total system. Alternatively, the finishing liquid can be prepared by introducing with stirring components (A), (C) and (D) in pure form and in appropriate proportions into the aqueous dispersion of component (B), thoroughly mixing the total system and adjusting the desired concentration by the addition of water.

For fine, velvety surfaces of a polyurethane layer liquid finishing compositions should preferably be used containing a higher amount of component (A) than for finishing rough, velvety surfaces. To finish finer velvety surfaces a composition containing 3 to 7.5 % by weight of component (A), 0.2 to 3 % by weight of component (B) and 0.1 to 1.5 % by weight of component C, each time calculated on the the total weight of the aqueous liquid, is especially suitable. With velvety surfaces having coarse pores and a long nap the irregularities of the surface cannot be compensated by a coating. In this case very good oleophobic and hydrophobic effects are obtained by coating the individual fibers or the pores of the said layer with a very thin coating; this means that the amount of component A in the finishing composition is reduced. Under such conditions a composition containing 1 to 3 % by weight of component (A), 0.2 to 3 % by weight of component (B) and 0.1 to 0.5 % by weight of component (C), calculated on the total weight of the aqueous composition, proved especially advantageous.

The aqueous finishing composition according to the invention is applied to the surface to be finished in an amount of from 60 to 150 g/m², preferably 80 to 100 g/m² (weight of used liquid) by known methods. All processes commonly used in textile finishing are suitable, for example dipping, rolling, padding, and preferably spraying. During the heat treatment under the conditions specified above, the reactive components are cured on the surface of the flat structure to be finished. The formed coating surprisingly adheres so firmly to the substratum that it is not removed even after repeated washing or dry-cleaning of the finished material.

By the use of the composition of the invention rough velvety surfaces of polyurethane layers, especially synthetic materials with leather-like characteristics, can be provided with properties which greatly improve the wearing behaviour and comfort when the materials are used for producing shoes and clothing. Above all, the coating formed with the composition does not reduce the permeability to water vapor and air the material possesses in itself. Additionally, the water repellent effect is so intensive that even after prolonged dynamic stress, for example by dilatation and compression, for instance with shoes on walking, or by friction, water cannot penetrate from the outside. It is thus possible to produce a material having pores and capillaries that are so large that the moisture given off by the feet or the body can be quantitatively transported to the outside. The moisture transport is promoted by the hydrophilic urethane, ether, and ester groups and the free terminal groups, such as amino and carboxy groups, of the material. Hence, the water vapor can rapidly migrate to the outside by a kind of bridge mechanism over the hydrophilic pore surface. The diffusion of air (venting popperty) through the pores and capillaries of the material is not hindered.

On the other hand, the penetration of water from the outside through the surface into the interior of the material is fully excluded even with strong mechanical stress. There is no detrimental effect of a barring layer placed under the rough surface which, furthermore, would raise the price of the material.

Agents used for finishing suede or velour leather of natural material are unsuitable for finishing the aforesaid synthetic materials on the basis of polyurethane and they do not confer on the latter the indicated favorable properties. Adhering finishings having a sufficient wear resistance cannot be obtained therewith. The advantageous effect of the finishing composition of the invention is apparently due, at least to a certain extent, to the chemical relationship of the formed coating with the surface of the material. This results in a further decisive advantage, the finish obtained is permanent and outlasts the service life of the material. The permanence and the film formation of the finish have the further advantage that a fashionable print on the rough surface is permanently protected against abrasion.

The finish obtained prevents the dirt from adhering to the surface and oil, fat and other stains can be readily wiped off with a cloth. The brilliancy of color of the material is maintained.

In addition, the finishing film has certain antistatic properties, whereby soiling is further diminished. The plasticizing, fat-like component of the finishing composition improves the hydrophobic effect and additionally confers a soft and pleasant handle on the originally strawy and hard surface of a roughened polyurethane surface.

The finishing composition of the invention can be used for the most various flat and shaped structures on the basis of poly-urethane having a rough suede-like or velvety surface, independent of whether the structures are made of one or several layers. The material finished according to the invention is used as upper leather for shoes, for clothing, for making bags and as upholstery and covering material.

The following examples illustrate the invention, the parts and percentages are by weight unless otherwise stated.

I) Finishing of polyurethane layers having a fine velvety suede-like surface

EXAMPLE 1

The finishing composition used contained per liter of water

A. 80 grams of a 50 % aqueous dispersion of melamineformaldehyde precondensate,

B. 15 grams of a dispersion of fluorine-containing substances containing $\beta_1$. 12.5 % of a polymer of

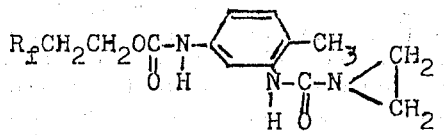

$R_f = C_6F_{13} : C_8F_{17} : C_{10}F_{21} = 1 : 1 : 1$
in which $R_f$ is $C_6F_{13} : C_8F_{17} : C_{10}F_{21}$ in a ratio of 1 : 1 : 1

$\beta_2$. 12.5 % of

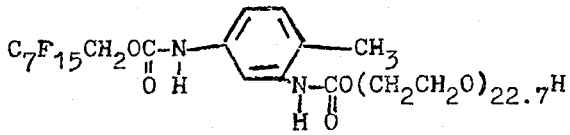

and 75 % of water,

C. 8 grams of a 22 % aqueous dispersion of octadecylethylene-urea ((N-octadecylcarbamoyl)-ethylene-imine) and D. 10 grams of magnesium chloride.

The finishing composition was uniformly sprayed in an amount of 100 g/m² onto the velvety surface of a polyurethane layer, which constituted the visible upper layer of a synthetic material with leater-like properties composed of a chemically bonded non woven fleece support and a microporous polyurethane layer with a velvety outer surface.

To remove the volatile portion of the finishing composition the flat structure was dried in a drying closet heated to 120° with hot air. After drying, the structure was exposed for 2 minutes to a radiation with an infrared radiator at 150°C.

The finished surface had a pleasant soft handle, an initial oil repellency of 130 and an initial water repellency of 80. In the present as well as in the following examples the oil repellency was tested according to the 3M test and the water repellency according to the AATCC test 22-1952, as described for example in U.S. Pat. No. 3,362,782, column 4.

EXAMPLE 2

The finishing composition used contained per liter of water:

A. 100 grams of a 50 % aqueous dispersion of urea-formaldehyde precondensate,

B. 20 grams of a dispersion of two fluorine-containing components of the same composition as in Example 1, C. 10 grams of a 22 % aqueous dispersion of octadecylethylene-urea and D. 8 grams of ammonium chloride.

The material to be treated and the finishing and drying conditions were the same as in Example 1. The final heat treatment was carried out for 5 minutes at 150°C. The surface had an initial oil repellency of 130 and an initial water repellency of 90.

EXAMPLE 3

The finishing composition contained per liter of water

A. 80 grams of a 50 % aqueous dispersion of urea-formaldehyde precondensate,

B. 15 grams of a dispersion of fluorine-containing components as defined in Example 1, C. 10 grams of a 22 % aqueous dispersion of octadecyltrimethylol urea, and D. 10 grams of magnesium chloride.

The finish was applied under the conditions of Example 2. The initial oil repellency was 120 and the initial water repellency 80.

II. Finishing of polyurethane layers having a velvety suede-like surface with coarse pores.

EXAMPLE 4

The finishing composition contained per liter of water:

A. 30 grams of a 50 % aqueous dispersion of melamineformaldehyde precondensate,

B. 15 grams of a dispersion of fluorine-containing compounds as defined in Example 1, C. 10 grams of a 22 % aqueous dispersion of octadecylethylene urea and D. 8 grams of magnesium chloride.

The finishing composition was applied to a polyurethane layer the surface of which differed from that of Example 1 by coarser pores and a longer nap. The finishing and drying conditions were the same as in Example 1. After drying the structure was heated for 5 minutes to 150°C in a drying closet operated with hot air.

The treated surface was soft and had a pleasant handle. Its initial oil repellency was 140, the water repellency amounted to 90.

EXAMPLE 5

The finishing composition contained per liter of water:

A. 20 grams of a 50 % aqueous dispersion of melamine-formaldehyde precondensate, B. 20 grams of a dispersion of fluorine-containing compounds as specified in Example 1, C. 8 grams of a 22 % aqueous dispersion of octadecylethylene-urea and D. 8 grams of ammonium chloride.

Finishing and drying were carried out under the conditions of Example 1, the thermal after treatment was performed for 5 minutes at 150°C. The initial oil repellency was 120, the initial water repellency was 70.

EXAMPLE 6

The finishing composition contained per liter of water:

A. 30 grams of a 50 % aqueous dispersion of urea-formaldehyde precondensate,

B. 25 grams of a dispersion of fluorine-containing components as specified in Example 1, C. 8 grams of a 22 % aqueous dispersion of octadecyltrimethylol-urea and D. 8 grams of magnesium chloride.

The finishing conditions were the same as in Example 1. The material had an initial oil repellency of 130 and an initial water repellency of 80.

EXAMPLE 7

The finishing liquid contained per liter of water:

A. 40 grams of a 50 % aqueous dispersion of melamineformaldehyde precondensate,

B. 25 grams of a dispersion of fluorine-containing components as specified in Example 1, C. 8 grams of a 22 % aqueous dispersion of octadecylethylene urea and D. 10 grams of magnesium chloride.

The finishing conditions were the same as in Example 1, the initial oil repellency was 120, the initial water repellency 70.

III) The following examples illustrate the fastness of the finish to washing and dry-cleaning.

EXAMPLE 8

The finishing composition contained per liter of water

A. 80 grams of a 50 % aqueous dispersion of urea-formaldehyde precondensate,

B. 15 grams of a dispersion of fluorine-containing components as specified in Example 1, C. 5 grams of a 22 % aqueous dispersion of octadecylethylene-urea and D. 8 grams of magnesium chloride.

The liquid was sprayed in an amount of 100 g/m² on a finely porous velvety surface of a polyurethane layer, dried at 120°C and cured for 5 minutes at 150°C. The following finishing values were obtained:

| | oil repellency unwashed | oil repellency after 1 cold washing | oil repellency after 1 hot washing |
|---|---|---|---|
| 3 M-test | 140 | 100 | 90 |
| AATCC-test 188/1966 | 7 | 5 | 4 |
| water repellency according to AATCC 22/1952 | | | 90 |

EXAMPLE 9

The finishing composition contained per liter of water

A. 40 grams of a 50 % aqueous dispersion of melamine-formaldehyde precondensate

B. 25 grams of a dispersion of fluorine-containing components as specified in Example 1, C. 10 grams of a 22 % aqueous dispersion of octadecylethylene-urea and D. 10 grams of magnesium chloride, A suede-like surface having coarse pores of a polyurethane layer was treated with the finishing composition as described in Example 8. The following values were measured:

| | unwashed | cold washing 1 × | cold washing 5 × |
|---|---|---|---|
| oil repellency (3 M-test) | 130 | 130 | 120 |

| | hot washing 1 × | hot washing 5 × | dry-cleaning 1 × | dry-cleaning 5 × |
|---|---|---|---|---|
| oil repellency (3 M-test) | 130 | 110 | 120 | 110 |

| | unwashed | cold washing 1 × | cold washing 5 × |
|---|---|---|---|
| oil repellency (AATCC-test 188/1966) | 7 | 7 | 6 |

| | hot washing 1 × | hot washing 5 × | dry-cleaning 1 × | dry-cleaning 5 × |
|---|---|---|---|---|
| oil repellency (AATCC-test 188/1966) | 7 | 6 | 5 to 6 | 5 |

| | unwashed | hot washing 5 × | dry-cleaning 5 × |
|---|---|---|---|
| water repellency (Spray test) AATCC 22/1952 | 70 to 80 | 50 to 70 | 50 to 70 |

Washing a dry-cleaning in Examples 8 and 9 were carried out under the following conditions:

Cold washing:

The samples were shaken and washed for 30 minutes in a commercial mild (light duty) detergent (5 g/l, goods to liquor ratio 1 : 10) in a Köttermann shaking apparatus of the type 4020 having a shaking frequency of 300 to and fro movements per minute (oscillation width 26 mm) and then rinsed for 5 minutes with tap water at room-temperature.

Hot washing:

In a household washing machine the samples were washed at 60°C together with polyester-cotton fabric as ballast in an amount to bring the load to 1.5 kg, using 140 g of a commercial heavy duty detergent. The samples were then dried at 50°C.

Dry-cleaning:

The samples were shaken for 10 minutes at about 25°C in perchloroethylene containing 1 % of a commercial cleaning promotor (high molecular weight condensation product on the basis of natural fatty acid amide derivatives) at a goods to liquor ratio of 1:10 in a Köttermann shaking apparatus of the type 4020 having a shaking frequency of 300 movements per minute and an oscillation width of 26 mm. The samples were then dried at 50°C.

COMPARATIVE EXAMPLE

The finely porous suede-like surface of a polyurethane layer was treated with a finishing composition composed as in Example 1, with the exception that component B consisted of 15 grams of a 40 % aqueous dispersion of the polymer of fluoroalkyl acrylate of the formula $C_7F_{15}CH_2OCO{\cdot}CH{=}CH_2$. The finishing conditions were the same as in Example 1. The initial oil repellency of the material was 70 and the initial water repellency 50 to 60.

We claim:

1. An aqueous composition of matter for the treatment of structures of polyurethane having a velvety surface comprising A. about 1 to about 10 % by weight of a water soluble aminoplast precondensate, B. about 0.1 to about 3 % by weight of a dispersion of a polymer consisting essentially of recurring units of the formula

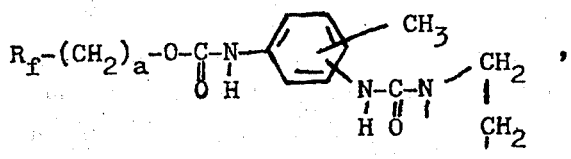

in which $R_f$ is perfluoroalkyl of 6 to 10 carbon atoms and *a* is 1 or 2, which polymer is dispersed in a dispersant of the formula

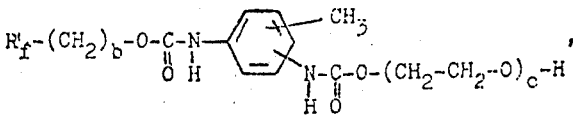

in which $R'_f$ is perfluoroalkyl of 5 to 7 carbon atoms, *b* is 1 or 2 and *c* is a number of about 18 to about 50, in which dispersion the ratio by weight of polymer to dispersant is from about 40 : 60 to about 60 : 40, C. about 0.05 to about 2 % by weight of a urea of the formula

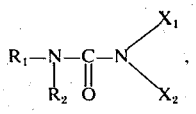

in which $R_1$ is alkyl of 8 to 24 carbon atoms, $R_2$, $X_1$ and $X_2$ each is hydrogen or hydroxymethyl or $X_1$ and $X_2$ together are ethylene, and D. about 0.05 to about 8 % by weight of a water soluble inorganic acidic cross-linking condensation catalyst.

2. An aqueous compostion as defined in claim 1, consisting essentially of about 1 to about 7.5 % by weight of (A),
about 0.2 to about 3 % by weight of (B),
about 0.1 to about 1.5 % by weight of (C) and
about 0.1 to about 6 % by weight of (D).

3. A composition as defined in claim 1, consisting of 3 to 7.5 % by weight of (A),
0.2 to 3 % by weight of (B),
0.1 to 1.5 % by weight of (C),
0.3 to 4.5 % by weight of (D), the balance to 100 % by weight being water.

4. A composition as defined in claim 1, consisting of 1 to 3 % by weight of (A),
0.2 to 3 % by weight of (B),
0.1 to 0.5 % by weight of (C),
0.1 to 1.8 % by weight of (D), the balance to 100 % by weight being water.

5. A composition as defined in claim 1, wherein the amount of (D) is 5 to 80 % by weight of the amount of (A).

6. A composition as defined in claim 1, wherein the amount of (D) is 10 to 60 % by weight of the amount of (A).

7. A composition as defined in claim 1, wherein in component (B) the ratio by weight of polymer to dispersant is 50 : 50.

8. A composition as defined in claim 1, wherein (A) is a condensation product of formaldehyde with melamine, urea or a compound of the formula

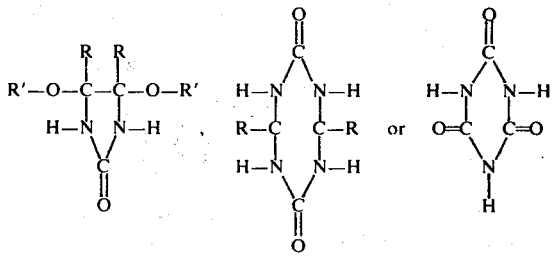

in which R and R′ are hydrogen or lower alkyl.

9. A composition as defined in claim 1, wherein (A) is a water-soluble precondensate of formaldehyde and urea or melamine.

10. A composition as defined in claim 1, wherein the polymer in (B) is a homopolymer or mixed polymer having a straight or branched per-fluoroalkyl of 7 to 8 carbon atoms on an average.

11. A composition as defined in claim 1, wherein the dispersant in (B) is a polyethylene glycol chain the value *c* of which is about 23 to about 46.

12. A composition as defined in claim 1, wherein (B) is a mixture of equal parts by weight of a mixed polymer consisting of recurring units of the formula

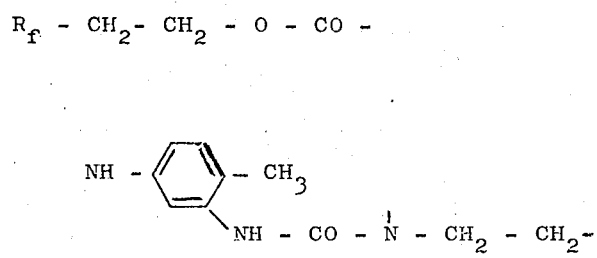

in which $R_f$ is n-$C_6F_{13}$, n-$C_8F_{17}$ and n-$C_{10}F_{21}$, which units are contained in the molecule in about equal parts by weight, and a dispersant of the formula

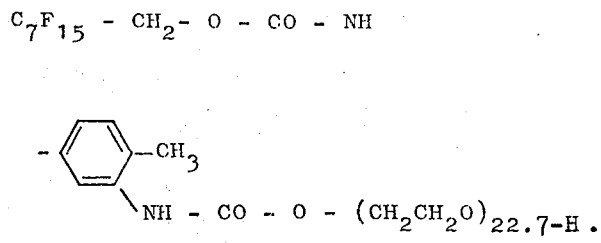

13. A composition as defined in claim 1, wherein (C) is stearyl trimethylol urea or N-stearyl - N′, N′-ethylene-urea.

14. A composition as defined in claim 1, wherein D is ammonium chloride, magnesium chloride, zinc chloride, zinc nitrate, zinc fluoborate or aluminum chloride.

15. A composition as defined in claim 14, wherein D is ammonium or magnesium chloride.

* * * * *